US006634645B1

(12) United States Patent
Yuan

(10) Patent No.: US 6,634,645 B1
(45) Date of Patent: Oct. 21, 2003

(54) CASINO CARD GAME

(76) Inventor: Tsuan Yuan, 4628 Nolan La., Las Vegas, NV (US) 89107

( * ) Notice: Subject to any disclaimer, the term of this patent is extended or adjusted under 35 U.S.C. 154(b) by 0 days.

(21) Appl. No.: 09/965,040

(22) Filed: Sep. 27, 2001

Related U.S. Application Data

(63) Continuation-in-part of application No. 09/120,967, filed on Jul. 22, 1998, now abandoned.

(51) Int. Cl.[7] ..... A63F 1/00
(52) U.S. Cl. ..... 273/292; 273/274
(58) Field of Search ..... 273/292, 274, 273/309; 463/12, 13

(56) References Cited

U.S. PATENT DOCUMENTS 5,863,042 A * 1/1999 Lo ..... 273/292
6,371,484 B1 * 4/2002 Yuan ..... 273/292

* cited by examiner

*Primary Examiner*—Benjamin H. Layno
(74) *Attorney, Agent, or Firm*—Anderson & Morishita; Robert Ryan Morishita

(57) ABSTRACT

A card game between a player and dealer begins by dealing two cards to each of the dealer and player. If either the player or dealer hand contains a predetermined two-card combination, such as a pair, that hand wins unless both contain a predetermined two-card combination, in which case the higher ranking two-card combination wins. If neither the hand includes a predetermined two-card combination, the higher and lower cards of the player hand are compared to the higher and lower cards, respectively, of the dealer hand. The player hand wins if both cards of the player hand outrank the corresponding cards of the dealer hand. The dealer hand wins if both cards of the dealer hand outrank the corresponding cards of the player hand. A push is declared if one of the player cards outranks the corresponding dealer card and the remaining dealer card outranks the remaining player card.

17 Claims, 2 Drawing Sheets

CASINO CARD GAME

RELATED APPLICATION DATA

The present application is a continuation-in-part of application Ser. No. 09/120,967 filed Jul. 22, 1998, now abandoned by applicant herein.

FIELD OF THE INVENTION

The present invention relates to casino card games. Specifically, the present invention is a card game in which a player is rewarded if, upon comparing his hand to a dealer's hand, the player's hand is the higher ranking hand.

BACKGROUND OF THE INVENTION

Casino games include many subsets of games. One well known subset of games includes games in which cards dealt to a player are combined into a single player's hand that is compared to a dealer hand. For example, in Blackjack, each player places a wager. A dealer deals two cards to each player and to himself. The dealer's cards are dealt with one card face up and the other face down. All players receiving a natural twenty-one or Blackjack, i.e. a total of twenty-one in the initial dealt hand, are immediately rewarded and their cards collected. Typically, Blackjacks are rewarded at greater than even money, such as 2:1 or 3:2.

Each remaining player may opt to hit, i.e. receive one or more additional cards, or stand, i.e. stand on the player's current hand, with the object being to obtain a hand total closer to twenty-one than the dealer's hand total. If the player hits and receives a card that causes his hand total to exceed twenty-one, the player busts and the player's wager is immediately collected and play is terminated as to that player.

A player may also have additional options available depending on the initial hand dealt. If the player receives a pair, i.e. two cards having the same face value, the player may double his wager and split the pair, using each card of the pair as a base for a separate hand. For example, if a player were to be dealt a pair of eights, the player may split the pair by doubling his wager and playing with two hands each having an eight and an additional dealt card.

A player may also have the option to double down. Although the availability of the double down option varies from casino to casino, doubling down allows a player to double the player's wager in exchange for a single additional card. Frequently, the double down option is only available to players having an initial hand total of ten or eleven.

After all the players have formed a final hand or busted, the dealer reveals the dealer's hand and forms a final dealer hand by hitting or standing as the house rules dictate. House rules typically require the dealer to hit on any hand total less than sixteen. The dealer resolves wagers by rewarding, typically at even money, all players with a final hand total closer to twenty-one than the dealer's final hand total.

Conversely, wagers are collected from players with a final hand total further from twenty-one than the dealer's final hand total. If the dealer busts, i.e. has a final hand total exceeding twenty-one, all players who did not bust or receive a Blackjack are rewarded, again, typically at even money. If the player and dealer push, i.e. have the same final hand total, the player's wager is returned.

Blackjack has its drawbacks, however. One known drawback is that in a fast paced casino game, the player must sum the cards of his or her hand quickly to avoid interfering with the flow of play. Additionally, the main impediment to quick play is the decision-making time required by each player in assessing his or her hand and determining how to play the hand.

Another subset of casino games include Pai Gow and games based on Pai Gow. These games are characterized by a step in which dealt cards or tiles are divided into two or more sub-hands.

For example, in Pai Gow Poker, seven cards are dealt to the banker and the players. The banker and players arrange the cards into a five-card high hand and a two-card low hand. Each player compares his or her high hand to the banker's high hand and his or her low hand to the banker's low hand. The player wins if both hands outrank the corresponding banker's hands according to conventional poker rankings. If one of the player's hands outranks one of the banker's hands, and the other banker's hand ties or outranks the other player hand, the player and banker "push" and the player neither wins nor loses his wager. If both the banker's hands outrank or tie the player's hands, the player loses his or her wager.

However, again, the decision-making time is the main impediment to fast play. Additionally, the game can be difficult to master and difficult to win for novices.

Thus, it can be seen that there is a need in the art for a casino card game that is simpler than prior art casino card games yet provides the player with a reasonable chance of winning.

SUMMARY OF THE INVENTION

A method for playing a card game for at least one player playing against a dealer uses conventional playing cards. In an optional gaming embodiment of the game, the game begins with the player placing a wager. A two card hand is dealt to the each of the dealer and player.

The wagers are resolved by first determining if either the player hand or dealer hand contains a predetermined two-card combination. In an optional embodiment, the two-card combination is a pair. If only one hand includes a two-card combination, the hand including the two-card combination is the winning hand.

If, however, both hands include a predetermined two-card combination, the player hand and dealer hands are compared. The hand with the higher ranking two-card combination is the winning hand. In an optional-embodiment, pairs are ranked according to face value. In a further optional embodiment, a pair of deuces may be elevated to outrank only the pair of aces. In yet a further embodiment, only the player is allowed to use a pair of deuces to outrank a pair of aces. That is, a pair of deuces in the player hand outranks a pair of aces in the dealer hand but a pair of deuces in the dealer hand does not outrank a pair of aces in the player hand.

If neither the player hand nor dealer hand includes a predetermined two-card combination, the wagers are resolved by comparing the higher card of the player hand to the higher card of the dealer hand and the lower card of the player hand to the lower card of the dealer hand. If the higher card of the player hand outranks the higher card of the dealer hand and the lower card of the player hand outranks the lower card of the dealer hand, the player hand is the winning hand. Similarly, if one of the player cards outranks the corresponding dealer card and the remaining dealer card outranks the remaining player card, a push is declared.

Conversely, if the higher card of the dealer hand outranks the higher card of the player hand and the lower card of the dealer hand outranks the lower card of the player hand, the dealer hand is the winning hand. In an optional embodiment, the dealer wins on all ties; that is, if the higher card of the dealer hand outranks or ties the higher card of the player hand and the lower card of the dealer hand outranks or ties the lower card of the player hand, the dealer hand is the winning hand.

In an embodiment in which the player has made a wager, a reward is issued to the player if the player hand is the winning hand. If a push is declared, the player's wager is returned. Finally, if the dealer hand is the winning hand, the player's wager is collected.

It is an object of the present invention to provide a game in which play can be easily mastered while still providing the player a reasonable opportunity to win.

DESCRIPTION

Figure 1:
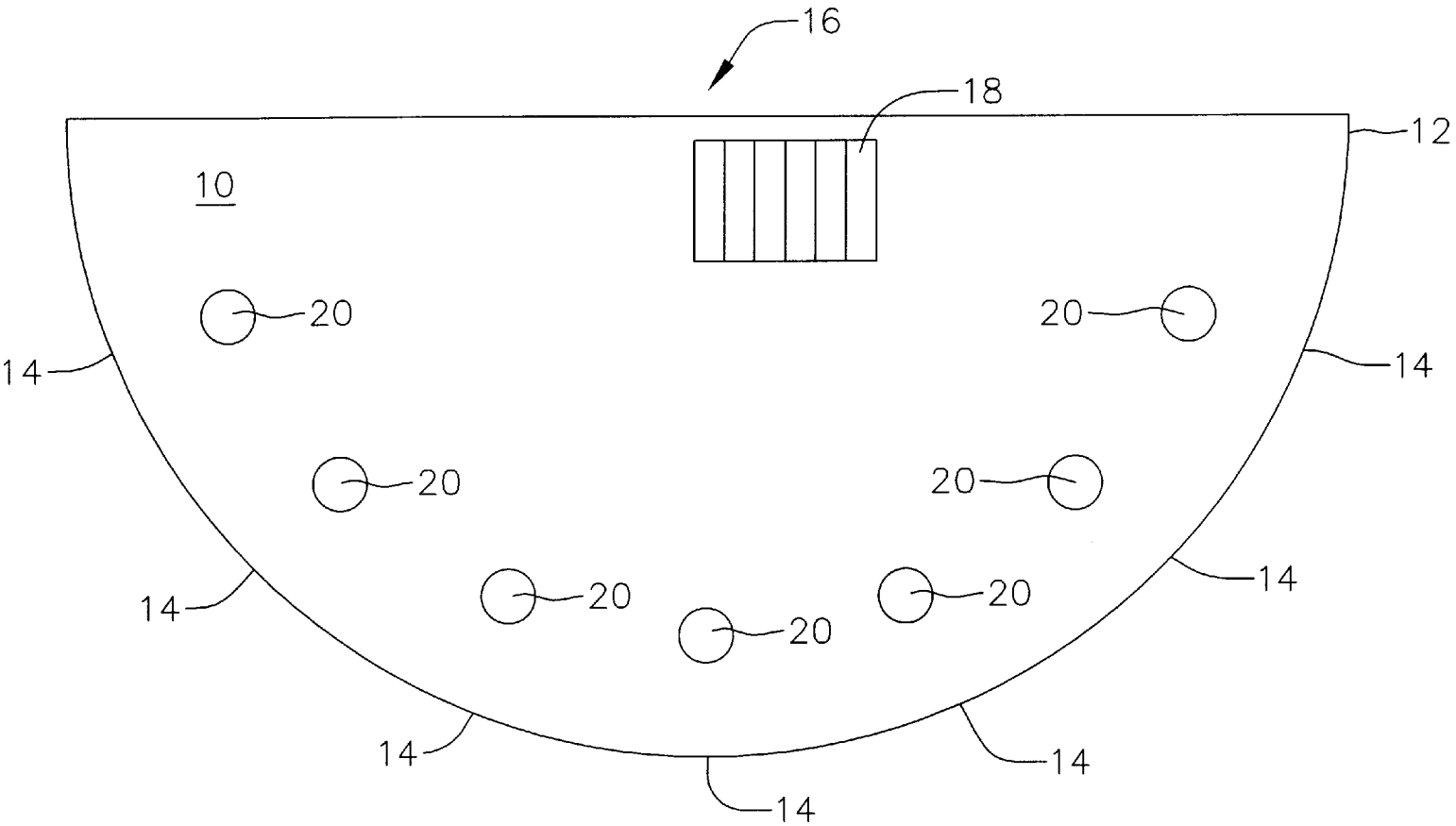
FIG. 1 is a top view of the table layout used for a game method according to an embodiment of the present invention.

Reference is now made to the figures wherein like parts are referred to by like numerals throughout. With reference to FIG. 1, the present invention is optionally played on a layout 10 on a gaming table 12. The gaming table 12 includes at least one player station 14 and a dealer station 16. The dealer station 16 optionally includes a check rack 18 for holding gaming checks (i.e. chips).

The game of the present invention is played between at least one player and a dealer for recreation or as a gambling game. In an optional embodiment of FIG. 2 in which the game is played as a gambling game, the game begins with a player making 22 a wager by placing a quantity of gaming checks in a wagering area 20 on the layout 10. It is contemplated that the game of the present invention may be house banked or have a rotating banker. However, the example below describes a house banked game in which a house dealer is also the banker.

Figure 2:
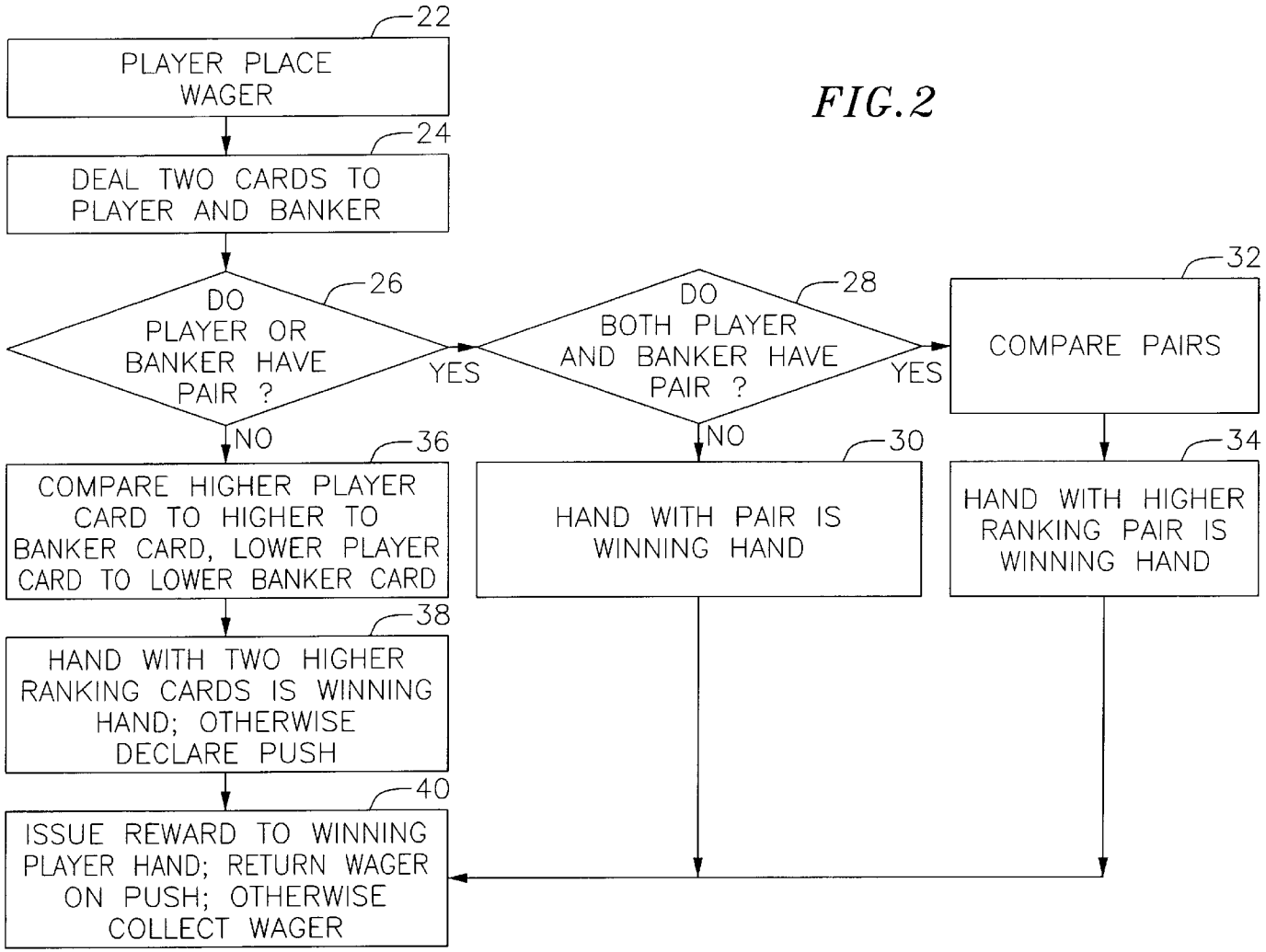
FIG. 2 is a flow chart of a game method according to an embodiment of the present invention.

The game of the present invention utilizes conventional playing cards. It is contemplated that any number of playing cards could be used. In the optional embodiment of FIG. 2, two decks of cards are used. With continued reference to FIG. 2, two cards are dealt 24 to each of the dealer and the player. The dealer and player each examine their hands and determine 26 if a pre-determined two-card combination has been obtained. While the eligible two card combinations could include any two-card combination, in an optional embodiment, more recognizable hands are used to aid players in determining when a desired two-card combination has been obtained. For example, two-card straights, two-card flushes, two-card straight flushes, or the like could be used. In the embodiment of FIG. 2, pairs are used as the two-card combination desired.

In comparing 28 the player and dealer hands, a hand, either the player or the dealer, automatically wins 30 if the pre-determined two-card combination is obtained unless the other hand has 32 a higher ranking two-card combination. In other words, a player hand with the pre-determined two-card combination automatically wins 30 unless outranked 32 by a two-card combination in dealer hand and vice versa. For example, in the embodiment of FIG. 2, a player with a hand of 7♡ 7♣ automatically wins 30 against a dealer hand of K♤ A♢ or a dealer hand of 5♣ 5♤. Similarly, a dealer hand of 8♡ 8♢ automatically wins 34 against a player hand of K♤ A♢ or 7♡ 7♣.

In ranking two-card combinations, any rules may be used. For example, in one optional embodiment, it may be desirable to use pairs ranked according to face value. That is, a pair of Aces outranks a pair of Kings, a pair of Kings outranks a pair of Queens, and so forth. Moreover, these rules may be altered such as a pair of deuces outranks a pair of Aces only, i.e. a hand 2♣ 2♤ wins against a hand A♡ A♣ but loses to any other pair. Significantly, asymmetrical rules may also be used. For example, in one optional embodiment, a player is allowed to use a pair of deuces to outrank a pair of Aces but the dealer is not, i.e. a player hand 2♣ 2♤ wins against a dealer hand A♡ A♣ but a dealer hand 2♣ 2♤ loses against a player hand A♡ A♣.

If neither the player hand nor the dealer hand includes a pre-determined two-card combination, the player hand and dealer hand are compared 36. In comparing 36 the player hand and dealer hand, the higher card of the player hand is compared to the higher card of the dealer hand and the lower card of the player hand is compared to the lower card of the dealer hand. In ranking the cards, any ranking system may be used. However for simplicity, in one optional embodiment, the face values of the cards are compared. That is, the conventional ranking of Ace outranks King outranks Queen and so forth down to deuce is used.

With continued reference to FIG. 2, if the player's higher card and lower card outrank 38 the dealer's higher card and lower card, respectively, the player's hand is the winning hand. For example, a player hand 9♢ 3♡ wins against a dealer hand 6♣ 2♤.

Conversely, if the dealer's higher card and lower card outrank 38 the player's higher card and lower card, respectively, the dealer's hand is the winning hand. For example, a dealer hand J♢ 5♢ wins against a player hand of 8♣ 3♢. While it is contemplated that either the player or dealer could win on tied cards, in the embodiment of FIG. 2, the dealer wins tied cards. That is, in the optional embodiment of FIG. 2, the dealer's hand is the winning hand if the dealer's higher card and lower card tie or outrank the player's higher card and lower card, respectively. In such an embodiment, a dealer hand K♣ 5♤ wins against a player hand Q♢ 5♣. Similarly, a dealer hand 7♢5♤ wins against a player hand 7♣ 5♢.

In the event that one of the dealer's cards outrank the corresponding player card, and the remaining player card outranks the remaining dealer card, a push is declared 38. For example, a player hand A♡ 7♤ pushes against a dealer hand 10♡ 8♢. When combined with optional tie card rules, such as those of the embodiment of FIG. 2, a player hand A♡ 7♤ pushes against a dealer hand J♣ 7♢.

In the gaming embodiment of the present game, if the player hand is the winning hand, the player is rewarded 40, optionally at even money. Conversely, if the dealer hand is the winning hand, the player's wager is collected 40. Likewise, a push results in the return 40 of the player's wager, i.e. a reward is not issued and the player's wager is not collected.

While certain embodiments of the present invention have been shown and described it is to be understood that the present invention is subject to many modifications and changes without departing from the spirit and scope of the claims presented herein.

I claim:

1. A method for playing a card game for at least one player playing against a dealer using conventional playing cards, comprising:

dealing a two card hand to each of the dealer and player;

comparing the dealer's two-card hand to the player's two-card hand and if either the player hand or dealer hand contains a predetermined two-card combination, declaring the hand with the two-card combination the winning hand unless both the player hand and dealer hand contain a predetermined two-card combination in which case the hand with the higher ranking two-card combination is the winning hand; and if neither the player hand nor dealer hand includes a predetermined two-card combination, (a) comparing the single higher card of the player hand to the single higher card of the dealer hand and the single lower card of the player hand to the single lower card of the dealer hand, (b) declaring the player hand the winning hand if the higher card of the player hand outranks the higher card of the dealer hand and the lower card of the player hand outranks the lower card of the dealer hand, (c) declaring the dealer hand the winning hand if the higher card of the dealer hand outranks the higher card of the player hand and the lower card of the dealer hand outranks the lower card of the player hand, (d) declaring a push if one of the player cards outranks the corresponding dealer card and the remaining dealer card outranks the remaining player card.

2. The method of claim 1 wherein the predetermined two-card combination is a pair.

3. The method of claim 2 wherein pairs are serially ranked according to the face value of the pair.

4. The method of claim 2 wherein pairs are serially ranked according to the face value of the pair except that a pair of deuces outranks a pair of aces only.

5. The method of claim 2 wherein pairs are serially ranked according to the face value of the pair except that a player hand containing a pair of deuces outranks dealer hand containing a pair of aces.

6. The method of claim 5 wherein a player hand containing a pair of aces outranks a dealer hand containing a pair of deuces.

7. A method for playing a casino card game for at least one player playing against a dealer using conventional playing cards, comprising:

the player placing a wager;

dealing a two card hand to each of the dealer and player;

comparing the dealer's two-card hand to the player's two-card hand and if either the player hand or dealer hand contains a predetermined two-card combination, declaring the hand with the two-card combination the winning hand unless both the player hand and dealer hand contain a predetermined two-card combination in which case the hand with the higher ranking two-card combination is the winning hand;

if neither the player hand nor dealer hand includes a predetermined two-card combination, (a) comparing the single higher card of the player hand to the single higher card of the dealer hand and the single lower card of the player hand to the single lower card of the dealer hand, (b) declaring the player hand the winning hand if the higher card of the player hand outranks the higher card of the dealer hand and the lower card of the player hand outranks the lower card of the dealer hand, (c) declaring the dealer hand the winning hand if the higher card of the dealer hand outranks or ties the higher card of the player hand and the lower card of the dealer hand outranks or ties the lower card of the player hand, (d) declaring a push if one of the player cards outranks the corresponding dealer card and the remaining dealer card outranks or ties the remaining player card; and issuing a reward to the player if the player hand is the winning hand, returning the player's wager if a push is declared, or collecting the player's wager if the dealer hand is the winning hand.

8. The method of claim 7 wherein the predetermined two-card combination is a pair.

9. The method of claim 8 wherein pairs are serially ranked according to the face value of the pair.

10. The method of claim 8 wherein pairs are serially ranked according to the face value of the pair except that a pair of deuces outranks a pair of aces only.

11. The method of claim 8 wherein pairs are serially ranked according to the face value of the pair except that a player hand containing a pair of deuces outranks dealer hand containing a pair of aces.

12. The method of claim 11 wherein a player hand containing a pair of aces outranks a dealer hand containing a pair of deuces.

13. A method for playing a casino card game for at least one player playing against a dealer using conventional playing cards, comprising:

the player placing a wager;

dealing a two card hand to each of the dealer and player;

comparing the dealer's two-card hand to the player's two-card hand and if either the player hand or dealer hand contains a pair, declaring the hand with the pair the winning hand unless both the player hand and dealer hand contain a pair in which case the hand with the higher ranking pair is the winning hand;

if neither the player hand nor dealer hand includes a pair, (a) comparing the single higher card of the player hand to the single higher card of the dealer hand and the single lower card of the player hand to the single lower card of the dealer hand, (b) declaring the player hand the winning hand if the higher card of the player hand outranks the higher card of the dealer hand and the lower card of the player hand outranks the lower card of the dealer hand, (c) declaring the dealer hand the winning hand if the higher card of the dealer hand outranks or ties the higher card of the player hand and the lower card of the dealer hand outranks or ties the lower card of the player hand, (d) declaring a push if one of the player cards outranks the corresponding dealer card and the remaining dealer card outranks or ties the remaining player card; and issuing a reward to the player if the player hand is the winning hand, returning the player's wager if a push is declared, or collecting the player's wager if the dealer hand is the winning hand.

14. The method of claim 13 wherein pairs are serially ranked according to the face value of the pair.

15. The method of claim 13 wherein pairs are serially ranked according to the face value of the pair except that a pair of deuces outranks a pair of aces only.

16. The method of claim 13 wherein pairs are serially ranked according to the face value of the pair except that a player hand containing a pair of deuces outranks dealer hand containing a pair of aces.

17. The method of claim 16 wherein a player hand containing a pair of aces outranks a dealer hand containing a pair of deuces.

* * * * *